United States Patent [19]

Saito et al.

[11] Patent Number: 4,917,727

[45] Date of Patent: Apr. 17, 1990

[54] METHOD OF OPERATING A BLAST FURNACE

[75] Inventors: Hiroshi Saito; Yotaro Oono, both of Tokyo; Hirohisa Hotta; Masahiro Matsuura, both of Yokohama, all of Japan

[73] Assignee: Nippon Kokan Kabushiki Kaisha, Tokyo, Japan

[21] Appl. No.: 279,252

[22] Filed: Nov. 22, 1988

Related U.S. Application Data

[63] Continuation of Ser. No. 884,979, Jul. 14, 1986, abandoned.

[30] Foreign Application Priority Data

Jul. 26, 1985 [JP] Japan ..... 60-165383

[51] Int. Cl.[4] ..... C21B 5/06

[52] U.S. Cl. ..... 75/460; 75/466

[58] Field of Search ..... 75/41, 42

[56] References Cited

U.S. PATENT DOCUMENTS

| | | | |
|---|---|---|---|
| 2,337,551 | 12/1943 | Hansgirg | 75/41 |
| 2,593,257 | 4/1952 | Bradley et al. | 75/41 |
| 2,952,533 | 9/1960 | Cuscoleca et al. | 75/42 |
| 3,460,934 | 8/1969 | Kelmar | 75/41 |
| 3,814,404 | 6/1974 | Claflin | 75/42 |

FOREIGN PATENT DOCUMENTS

| | | |
|---|---|---|
| 37-3356 | 6/1962 | Japan . |
| 50-22966 | 8/1975 | Japan . |
| 51-8091 | 3/1976 | Japan . |
| 52-32323 | 8/1977 | Japan . |
| 113814 | 9/1980 | Japan . |

*Primary Examiner*—Melvyn J. Andrews

*Attorney, Agent, or Firm*—Frishauf, Holtz, Goodman & Woodward

[57] ABSTRACT

According to a method of operating a blast furnace, pure oxygen, pulverized coal, and a temperature control gas which substantially does not contain nitrogen are blown from tuyères. A preheating gas which substantially does not contain nitrogen is blown from an intermediate shaft level. A blast furnace gas which substantially does not contain nitrogen can be produced from a furnace top.

8 Claims, 3 Drawing Sheets

METHOD OF OPERATING A BLAST FURNACE

This application is a continuation, of application Ser. No. 884,979, filed July 14, 1986 now abandoned.

BACKGROUND OF THE INVENTION

1. Field of the Invention

The present invention relates to a method of operating a blast furnace capable of generating a blast furnace gas having a composition suitable as a synthetic chemical industrial gas.

2. Description of the Prior Art

Most blast furnace gases generated in a conventional blast furnace are consumed in the steel works. However, the amount of gas consumed within such a plant has decreased in recent years in spite of the fact that the amount of blast furnace gas has increased due to the increase in the amount of pig iron manufactured and improvements in plant operation. Therefore, effective utilization of excess blast furnace gases has been a big problem.

It is thus assumed that a large amount of CO gas contained in the blast furnace gas can serve as a synthetic chemical industrial gas such as a fuel methanol gas.

Conventional blast furnace gas, however, contains a large amount of $N_2$ gas. In order to use the blast furnace gas as a synthetic chemical industrial gas, $N_2$ gas must be separated therefrom, resulting in high cost. Therefore, it is difficult to use the blast furnace gas as a synthetic chemical industrial gas on an industrial scale.

Japanese patent publication No. 37-3356 describes a method of operating a blast furnace wherein oxygen containing proper amounts of $CO_2$ gas and $H_2O$ steam in place of air is blown from blast furnace tuyères, and at the same time, a reduction gas essentially consisting of CO and $H_2$ separated from a B gas is blown, thereby setting the content of the reduction gas generated from the top of the furnace at 70%.

This technique aims at decreasing a coke ratio but not at producing a synthetic chemical industrial gas. This prior-art patent does not describe blowing of a preheating gas from an intermediate shaft level of the blast furnace or blowing of pulverized coal from the tuyères.

Japanese patent publication No. 52-32323 describes operations for blowing a top gas regenerated using fossil fuel together with oxygen-enriched gas from tuyères, and for blowing the regenerated top gas from an intermediate shaft level.

This technique also aims at a decrease in the coke ratio but not at producing a synthetic chemical industrial gas. According to this technique, an oxygen-enriched gas is blown, not pure oxygen. Unless nitrogen is removed from the resultant blast furnace gas, it cannot be used as a synthetic chemical industrial gas.

Japanese patent publication No. 50-22966 describes an operation wherein a nonoxidizing gas is blown at a temperature of 800° C. or a temperature higher than that of a charge from a blowing position into a region where the charge temperature is 700° C. or higher when a shaft furnace operation is performed using a preliminary reduced charge, thereby preheating the preliminary reduced charge and scrap.

This technique also aims at decreasing the coke ratio, but not at producing a synthetic chemical industrial gas. Since pure oxygen is not blown, the blast furnace gas cannot be used as a synthetic chemical industrial gas unless nitrogen is removed therefrom.

Japanese patent publication No. 51-8091 describes a technique for controlling oxygen and reduction gas contents to operate a blast furnace when an oxygen-enriched gas and a reduction gas are blown from tuyères.

This technique, however, aims at improving the productivity of pig iron, but not at producing a synthetic chemical industrial gas. According to this technique, a preheating gas is not blown from an intermediate shaft level. Since pure oxygen is not blown in the blast furnace, nitrogen must be removed from the blast furnace gas if it is to be used as a synthetic chemical industrial gas.

SUMMARY OF THE INVENTION

It is a first object of the present invention to provide a method of operating a blast furnace wherein a blast furnace gas, free from nitrogen, can be produced as a synthetic chemical industrial gas while a stable production of pig iron by the blast furnace is maintained.

It is a second object of the present invention to provide a method of operating a blast furnace wherein, even if pure oxygen is blown from tuyères, the theoretical flame temperature at the nose of tuyère is not excessively increased.

It is a third object of the present invention to provide a method of operating a blast furnace wherein a lack of gas in the upper portion of the furnace can be compensated, even if pure oxygen is blown from the tuyères.

It is a fourth object of the present invention to provide a method of operating a blast furnace wherein the amount of coke used can be reduced.

In order to achieve the above objects of the present invention, pure oxygen is blown from tuyères. A blast furnace gas generated from the furnace top is converted to a gas substantially free from nitrogen. An increase in the theoretical flame temperature at the nose of tuyère upon blowing of pure oxygen from the tuyères can be prevented by blowing a temperature control gas (e.g., steam, water, carbon dioxide, and a blast furnace gas generated from the furnace top) from the tuyères. In addition, the lack of gas in the upper portion at the furnace upon blowing of pure oxygen from the tuyères can be prevented by blowing from an intermediate shaft level a preheating gas which substantially does not contain nitrogen and used for preheating a blast furnace charge, e.g., a gas obtained by combusting the blast furnace gas of the furnace top. Furthermore, pure oxygen is blown so that pulverized coal can be blown from the tuyères, thereby decreasing the amount of coke in the charge.

The phrase "blast furnace gas which substantially does not contain nitrogen" includes a gas containing nitrogen (normally a concentration of 10% or less) which does not interfere with operation if it is used as a chemical gas. The phrase "preheating gas which substantially does not contain nitrogen" means a preheating gas containing an amount of nitrogen small enough to generate the blast furnace gas of the above composition. The term "pure oxygen" means oxygen of high purity containing an amount of nitrogen small enough to generate the blast furnace gas of the above composition.

DESCRIPTION OF THE PREFERRED EMBODIMENT

Example 1

Figure 1:
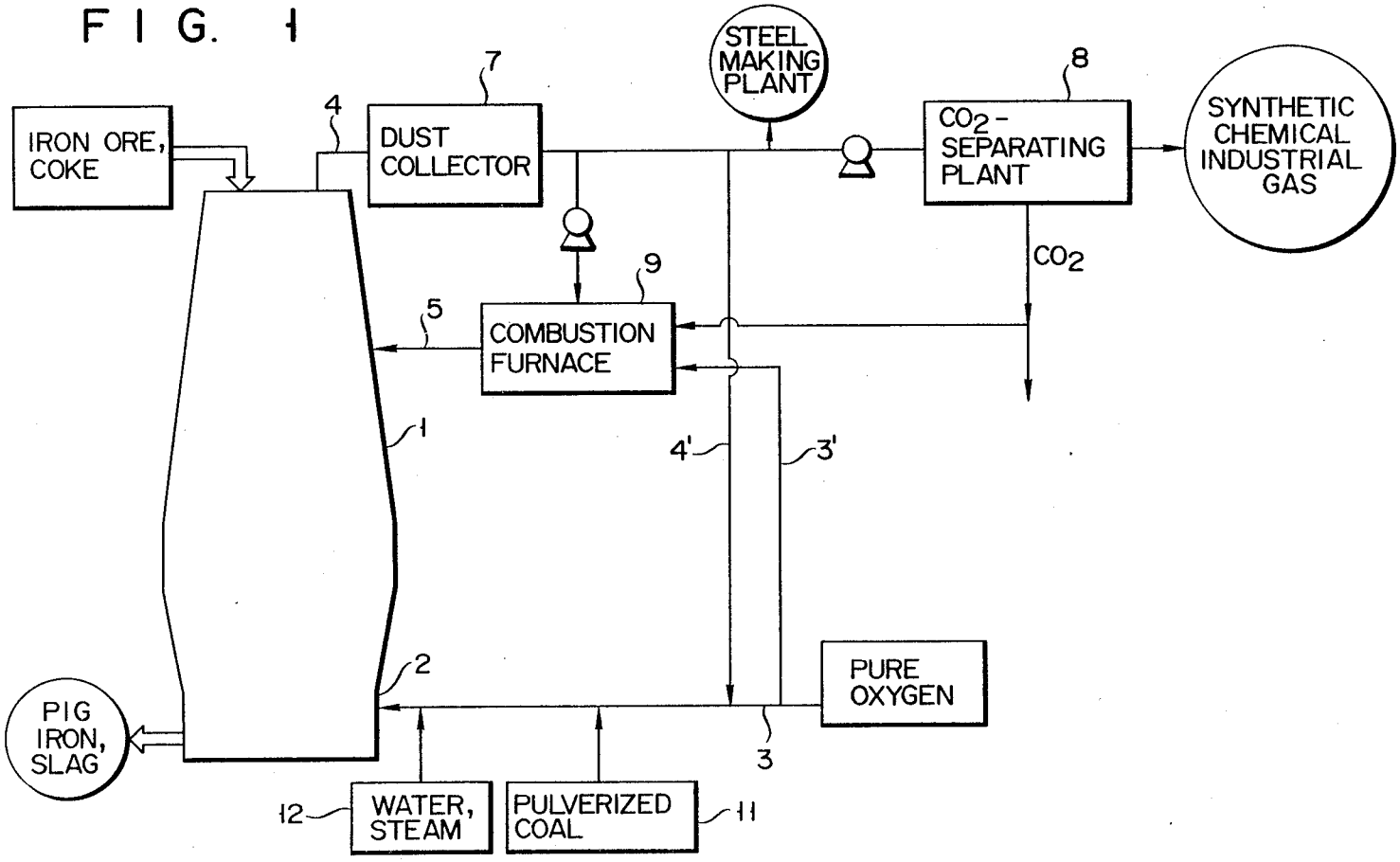
FIG. 1 is a schematic diagram for explaining an example of a method of operating a blast furnace according to the present invention.

FIG. 1 is a schematic diagram showing an example of a method of operating a blast furnace according to the present invention. A charge containing iron ore and coke as major constituents is charged into blast furnace 1 from a furnace top or receiving hopper. Pure oxygen 3, pulverized coal 11, $H_2O$ (water or steam) 12, and a blast furnace gas as temperature control gas 4' are blown from tuyères 2. Preheating gas 5, which substantially does not contain nitrogen, is blown from an intermediate shaft level of the blast furnace to preheat the charge. Coke and pulverized coal are combusted with pure oxygen, iron ore is reduced and melted to produce pig iron and slag, and blast furnace gas 4 which substantially does not contain nitrogen is generated from the furnace top.

Dust is removed from blast furnace gas 4 by dust collector 7. The resultant gas, free from dust, is diverted to different destinations. A portion is supplied to combustion furnace 9, another portion is supplied as temperature control gas 4' to tuyères 2, another portion is utilized in the steelmaking plant, and the remaining portion is supplied to $CO_2$-separating plant 8. The resultant CO and $H_2$ gases are used as a synthetic chemical industrial gas. $CO_2$ gas from $CO_2$-separating plant 8 can be supplied as a temperature control gas to preheating gas generation combustion furnace 9 or tuyères 2.

In the operation method described above, $H_2O$ 12 and temperature control gas 4' are blown from tuyères 2 to prevent temperature rise at the nose of tuyère caused by blowing of pure oxygen. The blowing rate is controlled to set a theoretical flame temperature at the nose of tuyère to be 2,000° to 2,600° C. Pulverized coal blowing from tuyères 2 is used as a substitute for coke. According to the present invention, since pure oxygen is blown from tuyères 2, a large amount of pulverized coal can be blown.

Figure 2:
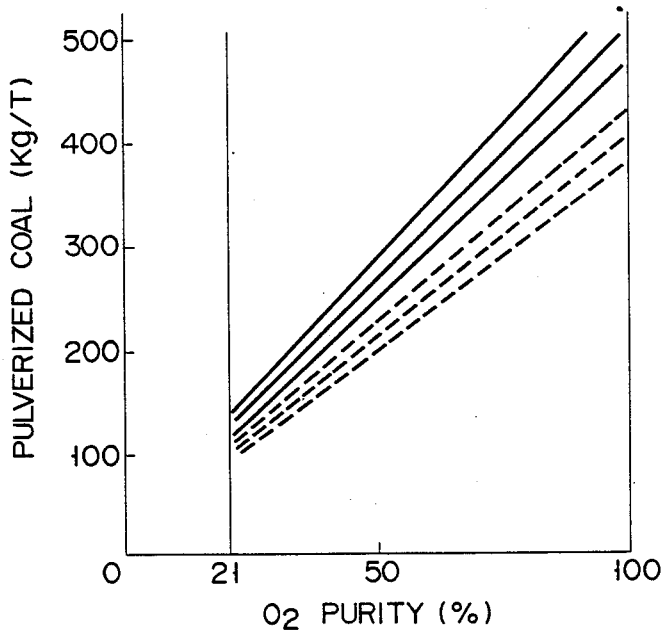
FIG. 2 is a graph showing the relationship between the concentration of oxygen blown from tuyères and the amount of pulverized coal.
Figure 3:
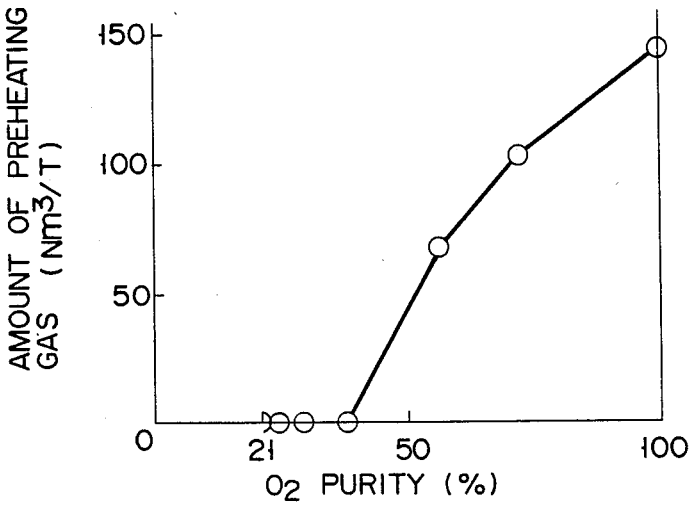
FIG. 3 is a graph showing the relationship between the concentration of oxygen blown from the tuyères and the preheating gas amount.

More specifically, when the concentration of oxygen blown from tuyères 2 is increased, the amount of pulverized coal is increased, as shown in FIG. 2, although the rate varies according to various conditions such as the type of pulverized coal. Upon an increase in concentration of oxygen blown from the tuyères, an amount of gas flowing through the furnace is decreased. For this reason, the gas must be replenished in the amount to compensate for shortage, as shown in FIG. 3. According to the present invention, blowing of pure oxygen from the tuyères and the preheating gas from the intermediate shaft level allows blowing of a large amount of pulverized coal, e.g., 400 kg/ton of pig iron, and preferably 100 to 400 kg/ton of pig iron. In other words, the amount of coke used in the operation can be greatly reduced.

In order to control the amount of latent heat from the blast furnace, $O_2$ top gas from the tuyères and a blowing rate of $H_2O$ are controlled to change a fuel ratio.

Preheating gas 5 is used to increase a gas flow within the furnace and to preheat the charge in the furnace. Gas 5 can be generated by combusting the blast furnace gas in combustion furnace 9 with oxygen 3'. The blowing rate of preheating gas 5 is determined by considering the amount of gas generated at a level below the blowing level such that a thermal flow ratio (solid/gas) preferably falls within the range of 0.8 to 1.0. If the thermal flow ratio is excessively low, a large amount of gas must be blown and its calories are wasted. However, if the thermal flow ratio is excessively high, a shortage of calories within the furnace occurs. The temperature in the furnace is then excessively decreased, and a failure to perform satisfactory gas reduction occurs. As a result, the furnace operation becomes unstable. The preheating gas temperature preferably falls within the range of 500° to 1,200° C. If the temperature is excessively low, chemical reduction cannot be sufficiently performed. However, if the temperature is excessively high, the solution loss increases. Therefore, the heat balance at the bottom of the furnace is disturbed, and the furnace operation becomes unstable. In addition, if iron ore reduction rate is high, the preheating gas temperature can be set to be low. However, if iron ore reduction rate is low, the preheating gas temperature can be set to be high. Therefore, without delaying the reduction reaction, the calories can be effectively utilized. The preheating gas temperature can be controlled by changing a ratio of the blast furnace gas recycled from furnace top to $O_2$.

According to the operation method described above, pure oxygen is blown and external $N_2$ gas is substantially not introduced to the system. Therefore, the blast furnace gas substantially does not contain $N_2$ gas, therefore $N_2$ need not be separated from the blast furnace gas. Only $CO_2$ gas is separated from the blast furnace gas to be used as a synthetic chemical industrial gas, as needed. Therefore, the cost of the gas can be greatly reduced.

The temperature rise at the nose of tuyère or its vicinity upon blowing of pure oxygen can be prevented by blowing the blast furnace gas circulated from the furnace top. In addition, the preheating gas blown from the intermediate shaft level prevents a shortage of gas flow, thereby stably operating the blast furnace. Furthermore, since pulverized coal is blown, the amount of coke used in the furnace can be greatly reduced, thereby reducing the operation cost. A required amount of blast furnace gas is subjected to $CO_2$ separation when it is used as a synthetic chemical industrial gas, thus further reducing the gas cost.

The operation of the blast furnace according to the present invention will be described with reference to FIG. 1.

Iron ore and coke (a coke ratio of 350 kg/T-HM or Ton-Hot Metal) were charged into a blast furnace (5,000 t-HM/d or Hot Metal/Day), and pure oxygen (349 $Nm^3/T$), a top gas (165 $Nm^3/T$), pluverized coal (300 kg/T-HM=21 t/H), and steam (3 kg/T) for preventing variations in blast furnace gas composition were blown in the furnace. A preheating gas (1,000° C., 105 $Nm^3/T$) was blown from the intermediate shaft portion of the blast furnace. In this case, the preheating gas was produced by combusting the top gas (105 $Nm^3/T$) with oxygen (10 $Nm^3/T$).

The composition of the top gas produced by the blast furnace operation described above was 49% of CO, 33.5% of $CO_2$, 9.2% of $H_2$, 0.73% of $H_2O$, and 0.8% of $N_2$. The top gas thus substantially does not contain $N_2$ gas. The blast furnace gas was passed through the dust-collecter, and the gas without dust was diverted to different destinations. A portion (105 $Nm^3/T$) was blown in the combustion furnace, another portion (165 $Nm^3/T$) was blown from the tuyères, another portion (1,080 $Nm^3/T$, 1,726 $Kcal/Nm^3$) was used in the steel works, and the remaining portion was subjected to $CO_2$ separation. The resultant CO and $H_2$ gases were used as a synthetic chemical industrial gas.

Example 2

Figure 4:
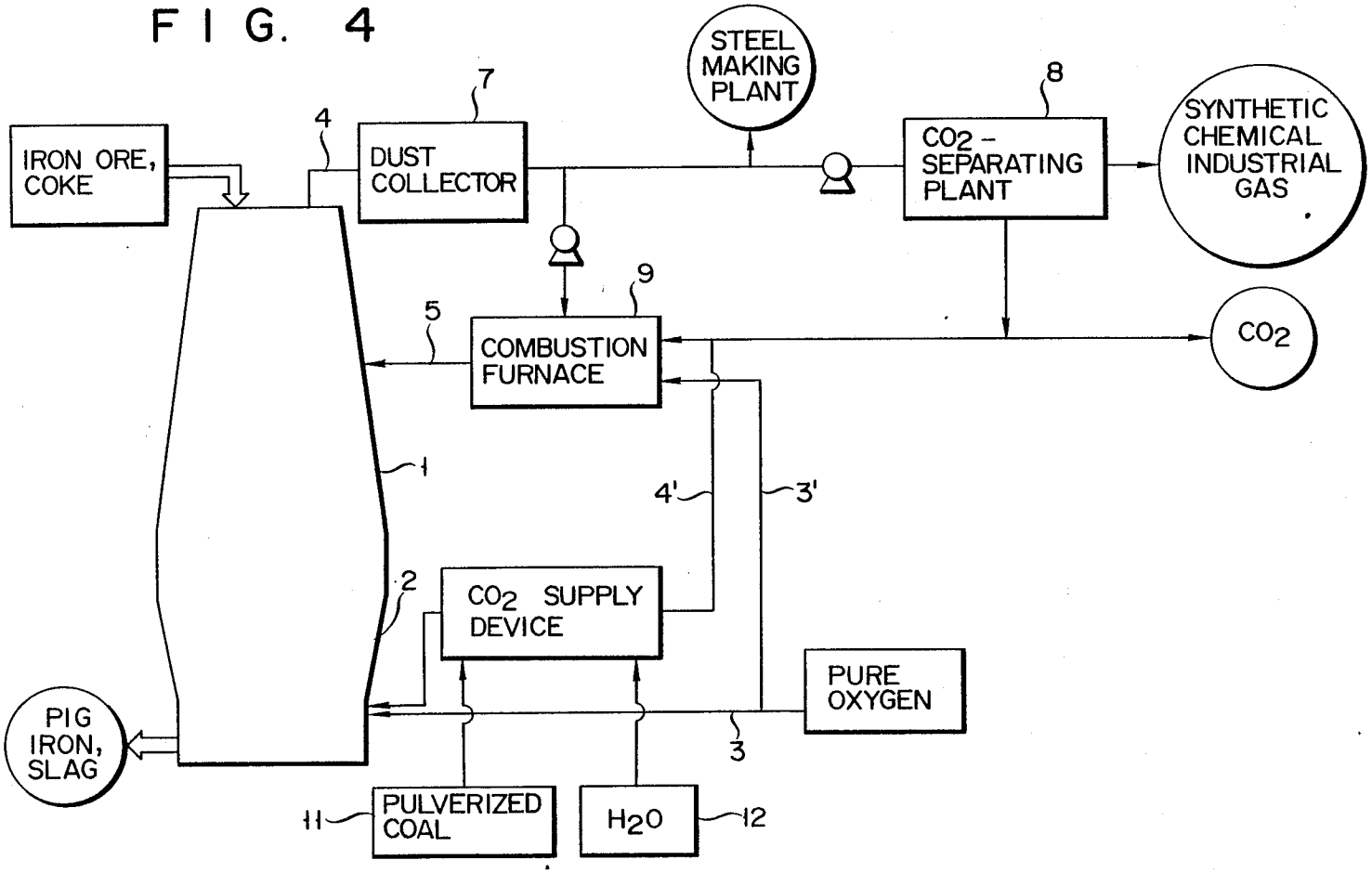
FIG. 4 is a schematic diagram for explaining another example of the method of operating a blast furnace according to the present invention.

FIG. 4 shows Example 2 of the method of operating the blast furnace according to the present invention. Blast furnace operation in FIG. 4 differs from that in FIG. 1 in that $CO_2$ gas, $H_2O$ (water or steam), or a gas mixture of $CO_2$ and $H_2O$ is blown as temperature control gas 4' from tuyères 2. The $CO_2$ gas is a portion of the $CO_2$ gas from $CO_2$-separating plant 8 and is supplied from $CO_2$ supply device 10 to tuyères 2. Another portion of the $CO_2$ gas from $CO_2$-separating plant 8 is supplied to combustion furnace 9 to control the temperature of preheating gas 5 generated by combusting the top gas. Example 2 preferably follows the same procedures as in Example 1 and obtains the same effect as therein.

Example 2 will be described with reference to FIG. 4.

Iron ore and coke (a coke ratio of 500 kg/T-HM) were charged into a blast furnace (5,000 t-HM/d), and pure oxygen (75,000 $Nm^3/H$), $CO_2$ (40,000 $Nm^3/H$), and pulverized coal (100 kg/T-HM=21 t/H) were blown from the tuyères. A preheating gas (1,000° C., 83,000 $Nm^3/H$ $27\times20^6$ Kcal/H) was blown from the intermediate shaft level. The preheating gas was obtained by combusting a blast furnace gas (14,600 $Nm^3/H$) with oxygen (5,000 $Nm^3/H$), and the temperature of the preheating gas was controlled with $CO_2$ (25,000 $Nm^3/H$).

The composition of the blast furnace gas obtained by the above blast furnace operation was 53% of CO and 47% of $CO_2$. This blast furnace gas substantially does not contain $N_2$ gas. After the gas was passed through the dust-collecter, a gas portion (14,600 $Nm^3/H$) was blown in the combustion furnace, another gas portion (81,000 $Nm^3/H$, 1,590 $Kcal/Nm^3$) was used in the steel-making plant, and the remaining portion (135,000 $Nm^3/H$) was subjected $CO_2$ separation and used as a synthetic chemical industrial gas. The $CO_2$ gas obtained upon $CO_2$ separation was 25,800 $Nm^3/H$. A predetermined amount of gas was used as a preheating gas temperature control gas and a pulverized coal carrier gas.

What is claimed is:

1. A method of operating a blast furnace having a furnace top, a shaft and a hearth fitted with tuyeres opening to said hearth at a tuyeres nose, comprising the steps of:

charging a charge including iron ore and coke as major constituents from said furnace top into said blast furnace;

blowing pure oxygen, pulverized coal, and a temperature control gas from said tuyeres, said temperature control gas being adapted to prevent a temperature rise at the nose of said tuyere;

blowing an oxidizing preheating gas which is substantially devoid of nitrogen from an intermediate level of said shaft to increase the volume of gas upward from said intermediate level of said shaft and to preheat the charge in said blast furnace to a temperature of from 500° to 1,200° C. such that reduction of said charged iron ore can take place at a satisfactory reaction rate; and combusting coke with said pure oxygen to melt said iron ore and to generate a blast furnace gas which is substantially devoid of nitrogen.

2. A method according to claim 1, wherein the temperature control gas is a gas selected from the group consisting of $H_2O$, $CO_2$, and a gas mixture thereof, and is blown such that a theoretical flame temperature at the nose of tuyère falls within a range of 2,000° to 2,600° C.

3. A method according to claim 1, wherein the temperature control gas is a gas generated from a top of the blast furnace and is blown such that a theoretical flame temperature at the nose of tuyère falls within a range of 2,000° to 2,600° C.

4. A method according to claim 1, wherein the amount of the preheating gas is controlled such that a thermal flow ratio of solid to gas is set to be 0.8 to 1.0.

5. A method according to claim 1, wherein said pulverized coal is blown in an amount up to 400 kg/ton of pig iron.

6. A method of operating a blast furnace having a furnace top, a shaft and a hearth fitted with tuyeres opening to said hearth at a tuyere nose, comprising the steps of:

charging a charge including iron ore and coke as major constituents from said furnace top into said blast furnace;

blowing pure oxygen and a temperature control gas from said tuyeres, said temperature control gas being adapted to prevent a temperature rise at the nose of said tuyere;

blowing an oxidizing preheating gas which is substantially devoid of nitrogen from an intermediate level of said shaft to preheat the charge in the blast furnace to a temperature of from 500° to a temperature of from 500° to 1,200° C. at which the reduction of said charged iron ore can take place at a satisfactory reaction rate, the amount of said preheating gas being controlled to increase the volume of gas upward from said intermediate level of said shaft such that a thermal flow ratio of solid to gas is 0.8 to 1.0; and combusting coke with said pure oxygen to melt said iron ore and to generate a blast gas which is substantially devoid of nitrogen.

7. A method according to claim 6, wherein the temperature control gas is a gas selected from the group consisting of $H_2O$, $CO_2$, and a gas mixture thereof, and is blown such that a theoretical flame temperature at the nose of tuyère falls within a range of 2,000° to 2,600° C.

8. A method according to claim 6, wherein the temperature control gas is a gas generated from a top of the blast furnace and is blown such that a theoretical flame temperature at the nose of tuyère falls within a range of 2,000° to 2,600° C.

* * * * *

UNITED STATES PATENT AND TRADEMARK OFFICE

CERTIFICATE OF CORRECTION

PATENT NO. : 4,917,727

DATED : April 17, 1990

INVENTOR(S) : SAITO et al

It is certified that error appears in the above-identified patent and that said Letters Patent is hereby corrected as shown below:

Title page, Section [56] References Cited:

Insert under "U.S. PATENT DOCUMENTS"

--3,620,699 11/1971 Reynolds et al.....48/212
4,198,228 4/1980 Jordan--

Insert under "FOREIGN PATENT DOCUMENTS"

-- 31249 9/1950 Australia
10374 3/1973 Australia
1218912 1/1971 Great Britain
980962 5/1951 France
2486962 1/1982 France
81/02584 9/1981 European--

Change "113818 9/1980 Japan" to --55-113814 9/1980 Japan--.

Column 6, line 46 (claim 6), delete "to a temperature of from 500°" (first occurrence).

Signed and Sealed this

Sixteenth Day of November, 1993

Bruce Lehman

Attest:

BRUCE LEHMAN

Attesting Officer

Commissioner of Patents and Trademarks